US010228656B2

(12) United States Patent
Waeckerlin et al.

(10) Patent No.: US 10,228,656 B2
(45) Date of Patent: Mar. 12, 2019

(54) SCREW-DOWN ORIENTABLE CROWN

(71) Applicant: Meco S.A., Grenchen/Granges (CH)

(72) Inventors: Simon Waeckerlin, Grenchen (CH); Christian Olvaszto, Grenchen (CH); Jean Baebler, Guemligen (CH)

(73) Assignee: Meco S.A., Grenchen (CH)

( * ) Notice: Subject to any disclaimer, the term of this patent is extended or adjusted under 35 U.S.C. 154(b) by 0 days.

(21) Appl. No.: 15/665,458

(22) Filed: Aug. 1, 2017

(65) Prior Publication Data

US 2018/0039229 A1 Feb. 8, 2018

(30) Foreign Application Priority Data

Aug. 2, 2016 (EP) ..... 16182372

(51) Int. Cl.
*G04B 37/10* (2006.01)
*G04B 3/04* (2006.01)

(52) U.S. Cl.
CPC ..... *G04B 37/103* (2013.01); *G04B 3/043* (2013.01)

(58) Field of Classification Search
CPC ..... G04B 37/04; G04B 37/10; G04B 37/103; G04B 37/106
See application file for complete search history.

(56) References Cited

U.S. PATENT DOCUMENTS

| | | | |
|---|---|---|---|
| 2003/0007426 A1 | 1/2003 | Ecoffet | |
| 2013/0100782 A1 | 4/2013 | Cattaneo et al. | |
| 2013/0114383 A1 | 5/2013 | Gourdin | |
| 2014/0169144 A1 | 6/2014 | Briswalter et al. | |

FOREIGN PATENT DOCUMENTS

| | | | |
|---|---|---|---|
| CH | 705 218 B1 | 1/2013 | |
| EP | 0026740 A1 * | 4/1981 | ..... G04B 3/04 |
| EP | 1 727 005 A1 | 11/2006 | |
| EP | 2 182 417 A2 | 5/2010 | |
| EP | 2 385 432 A2 | 11/2011 | |
| EP | 2 592 500 A1 | 5/2013 | |
| EP | 2 746 870 A1 | 6/2014 | |

OTHER PUBLICATIONS

Machine Translation of EP0026740.*
Machine Translation of EP2182417.*
European Search Report dated Mar. 8, 2017 in European Application 16182372.9, filed on Aug. 2, 2016 ( with English Translation of Categories of Cited Documents).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

The invention relates to a screw-down orientable crown comprising a cover integral with a tube and receiving a distinctive sign, a fixed body pressed into a watch case middle and intended to receive the tube, and means for adjusting the angular orientation of the cover with respect to the case middle. According to the invention, the means for adjusting the angular orientation of the cover comprise a ring arranged to be screwed onto the tube, said ring comprising first indexing means arranged to cooperate with second indexing means formed in the body, the ring being pressed in and positioned on the body via the first and second indexing means.

13 Claims, 2 Drawing Sheets

SCREW-DOWN ORIENTABLE CROWN

This application claims priority from European Patent Application No. 16182372.9 filed on Aug. 2, 2016, the entire disclosure of which is hereby incorporated herein by reference.

FIELD OF THE INVENTION

The invention relates to a device for adjusting the orientation of screw-in or screw-down crowns for timepieces and more specifically for such crowns having a motif or logo on their end face and in which the motif can be oriented as desired.

BACKGROUND OF THE INVENTION

Screw-down crowns are commonly used to equip watches in order to improve the sealing of said watches at their winding or control stem. This type of crown has the peculiarity of being able to assume an unscrewed position in which the watch can be wound, set etc., and a screwed-down position in which the crown is screwed down and locked onto a tube pressed or screwed into the middle part of the watch case to compress a sealing gasket, thereby improving the sealing of the watch. The screwed-down position in thus that which corresponds to the normal position when the watch is worn and which is more or less always the same, with the exception of wear to the sealing gasket.

The manufacture and assembly of these screw-down crowns in watch cases are well known. However, the methods for assembling such crowns are ill suited to screw-down crowns bearing an inscription or a motif, for example a logo, a trademark or similar sign, on their end face. Indeed, known manufacturing methods do not generally allow the crown to be brought into a determined orientation with respect to the case once screwed down, which impairs the aesthetic appearance of the case when an inscription is applied to the end face of the crown. This situation is, of course, unacceptable when such crowns are fitted to high quality and luxury products.

One solution that allows a crown to be adjusted in a determined position or orientation after being screwed onto the tube has already been proposed in EP Patent Application 1124167A1. According to this document, a ring made of shape memory alloy is placed either between the case middle and the tube, or between the crown and the tube. By using the deformation of the ring, in particular reducing its diameter by subjecting the watch to specific temperatures, a temporary clearance can be created between the case middle and the tube and between the crown and the tube respectively, and this clearance allows angular adjustment of the crown in its screwed-down position. A drawback of this solution lies in the fact that shape memory alloys are not currently available in the form of bars of small dimensions, so that it is difficult and expensive to machine the rings in question in the small dimensions required for the applications concerned. Moreover, this process is only intended for the initial assembly of the crown by the watch manufacturer, but not for subsequent operations to adjust the orientation of the crown, which would risk damaging other parts of the watch which are sensitive to temperature variations.

EP Patent 1701225 describes a screw-down orientable crown including a head integral with a winding stem and a cover on which an inscription appears, the head and the cover being integral in rotation by means of truncated cone-shaped surfaces held in contact with one another via a resilient element. Adjustment of the angular position of the cover is achieved by axially pulling out the latter relative to the case middle along the longitudinal axis of the crown. A major drawback of this solution is that the cover is made integral in rotation with respect to the head only by the friction forces between the truncated cone-shaped surfaces, which is not sufficiently reliable over the service life of a watch, and particularly when the compression forces exerted by the resilient element gradually diminish. Moreover, another drawback is that it is not possible to guarantee that the same angular position can be obtained in a precise manner, since the angular position can only be determined by successive approximations.

EP Patent 1411401 describes a crown comprising an orientable substrate on its upper outer face, the substrate being provided with an inscription and rotationally disengageable from the head of the crown when pressure is exerted against braking means. The drawback of this solution is that it is not robust to shocks, which may also exert a pressure force on the substrate and thereby reorientate the substrate in an undesired manner with respect to the body of the crown. Moreover, numerous precautions must be taken when handling the crown to avoid applying any pressure force towards the case middle to prevent an untimely rotation of the substrate, which makes the crown inconvenient to use.

SUMMARY OF THE INVENTION

It is an object of the invention to overcome the various drawbacks of these known techniques.

More specifically, it is an object of the invention to provide a device for the orientation of a screw-down crown of simple and economic construction, comprising a motif such as a logo or a trademark and wherein the position of the logo or the trademark applied to the end face of the crown can easily be adjusted in a determined position or orientation.

It is also an object of the invention to provide a more reliable screw-down orientable crown that those proposed hitherto.

These objects, in addition to others which will appear more clearly hereinafter, are achieved by the invention by means of a screw-down orientable crown comprising a cover integral with a tube and receiving a distinctive sign, a fixed body mounted inside a watch case middle part and intended to receive the tube, and means for adjusting the angular orientation of the cover with respect to the case middle.

According to the invention, the means for adjusting the angular orientation of the cover comprise a ring arranged to be screwed onto the tube, said ring comprising first indexing means arranged to cooperate with second indexing means formed in the body, the ring being pressed in and positioned in the body via the first and second indexing means.

As a result of these features, the orientation of the motif borne by the cover can easily be adjusted in a specific, long-term reproducible angular position with respect to the case middle, at the same time preventing any accidental handling error on the part of the user.

Moreover, this new construction has the advantage of being invisible to the user from the exterior of the crown, since the proposed adjustment device is covered and concealed by the cover. The aesthetic appearance of the watch is thus unaffected.

In accordance with other advantageous variants of the invention:

the first and second indexing means each include flutes configured to be axially engaged one inside the other;

the ring is pressed between the tube and the body; the tube, the ring and the body being housed inside an annular groove formed in the cover.

the body has an inner shoulder forming a stop for the ring;

the tube includes a stop surface for abutting against the ring;

sealing means are disposed between the cover and the body;

the tube includes an external thread arranged to cooperate with a threaded section of the ring for screwing down/unscrewing the crown;

the ring is pressed between the body and the cover.

The invention also concerns a method for mounting a crown according to the invention on a watch case middle.

The invention also concerns a timepiece including a crown according to the invention.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

A control member according to a particular embodiment will now be described below referring jointly to FIGS. 1, 2*a*, 2*b*, and 3.

Figure 1:
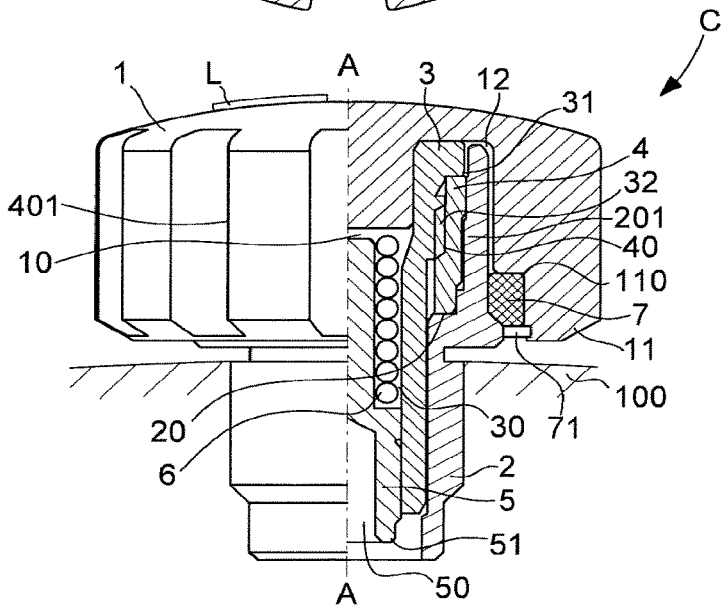
FIG. 1 is a sagittal cross-sectional view of a screw-down orientable crown according to the invention.

The preferred embodiment illustrated in FIG. 1 shows a sagittal cross-sectional view of a screw-down crown, designated by the general reference C, along its axis of rotation A-A, to reveal the orientation adjustment mechanism according to a preferred embodiment of the invention. The crown is represented here in a screwed-down position, and includes a cover 1 integral with a tube 3 sliding inside a fixed body 2, which may be pressed, or screwed and/or bonded, in a sealed manner, in a watch case middle 100. According to the invention, crown C also includes means for adjusting the angular orientation of cover 1 with respect to the watch case middle, in order to orient the angular position of the distinctive sign L found on cover 1. Sealing means 10 are disposed between cover 1 and body 2.

The sealing means comprise a gasket 7, such as, for example, an O-ring joint, inserted between body 2 and skirt 11 of cover 1, to guarantee the sealing of the watch. Gasket 7 is disposed in an annular housing 10 provided in skirt 11 of cover 1, which extends along body 2 and is held in place by means of a retaining ring 71.

The means for adjusting the angular orientation of cover 1 comprise a ring 4 arranged to be screwed onto tube 3, ring 4 including first indexing means arranged to cooperate with second indexing means formed in body 2. In the illustration of FIG. 1, tube 3 includes an external thread 32 arranged to cooperate with a threaded section 40 of ring 4 to screw-down and/or unscrew the crown. Advantageously, ring 4 is positioned and then pressed into body 2 by means of the first and second indexing means.

According to a first embodiment of the invention, the first and second indexing means include flutes or toothings configured to axially engage one inside the other in order to correctly position cover 1. Preferably, ring 4 is pressed into body 2 once it has been screwed onto tube 3 carrying cover 1.

In the illustration of FIG. 1, the central portion of the crown is connected to a winding stem (not represented) of the timepiece movement via the threaded blind hole 50 provided in the lower portion 51 of a piston 5, housed inside an axial cavity 30 inside tube 3. Piston 5 slides against a spring 6 in abutment on an inner surface 10 of cover 1, and, in particular, enables cover 1 to emerge from the case middle when the crown is unscrewed to perform an adjustment. As piston 5 is intended to be connected to the winding stem, its axial position with respect to the case middle is indexed, typically by three discreet values, the first corresponding, for example, to winding the mainspring, another to time adjustment, and a third to date adjustment.

According to the invention, cover 1 is assembled on tube 2 so that they are usually rotationally and axially integral; this assembly is achieved in a removable or reversible manner.

Cover 1 includes an axial skirt 11, inside which is formed an annular groove 12 arranged for receiving the end of body 2 integral with case middle 100, but also tube 3, ring 4 being placed between tube 3 and body 2. Cover 1 includes an upper surface on which is applied a distinctive sign L, such as a logo or a trademark, visible from the exterior of the crown—for example, the Omega logo can be seen in the Figures.

According to the preferred illustrated embodiment, the first and second indexing means are inserted between inner surface 200 of body 2, and outer surface 400 of ring 40, and include flutes 201 and 401, respectively arranged on the inner surface of body 2 and outer surface 400 of ring 40. In the illustrated embodiment, the flutes cooperate axially in the direction of the axis of rotation A-A, to perform the operation to adjust the orientation of crown C.

Figure 2A:
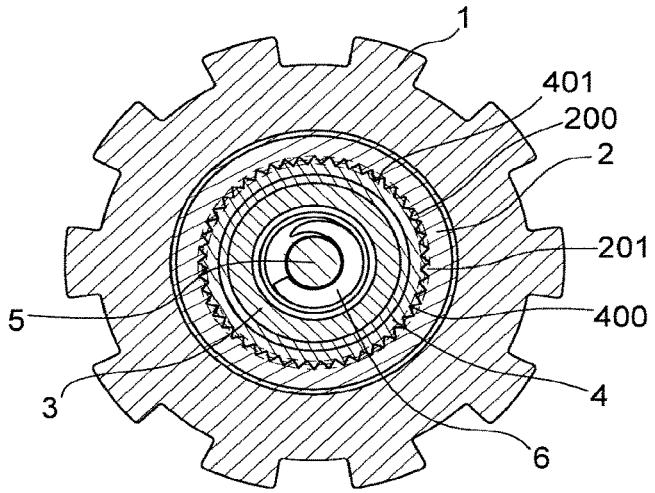
FIGS. 2*a* and 2*b* are respectively a transverse cross-sectional view of a screw-down orientable crown and a sagittal cross-sectional view of a screw-down crown according to the invention before the ring is pressed into the body.
Figure 2B:
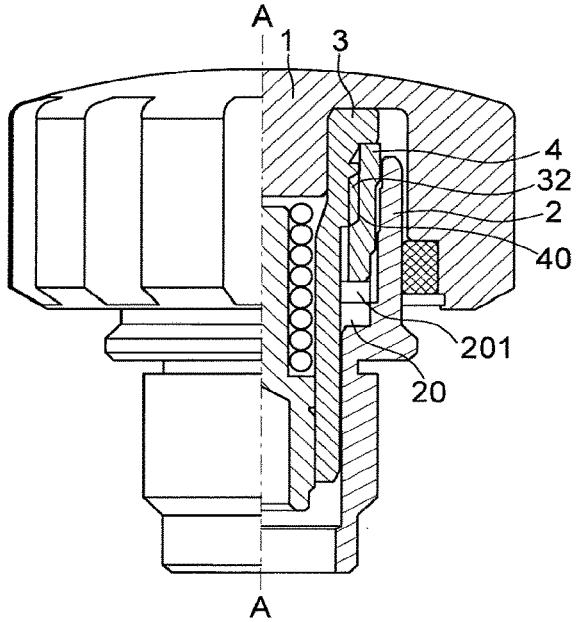
Figure 3:
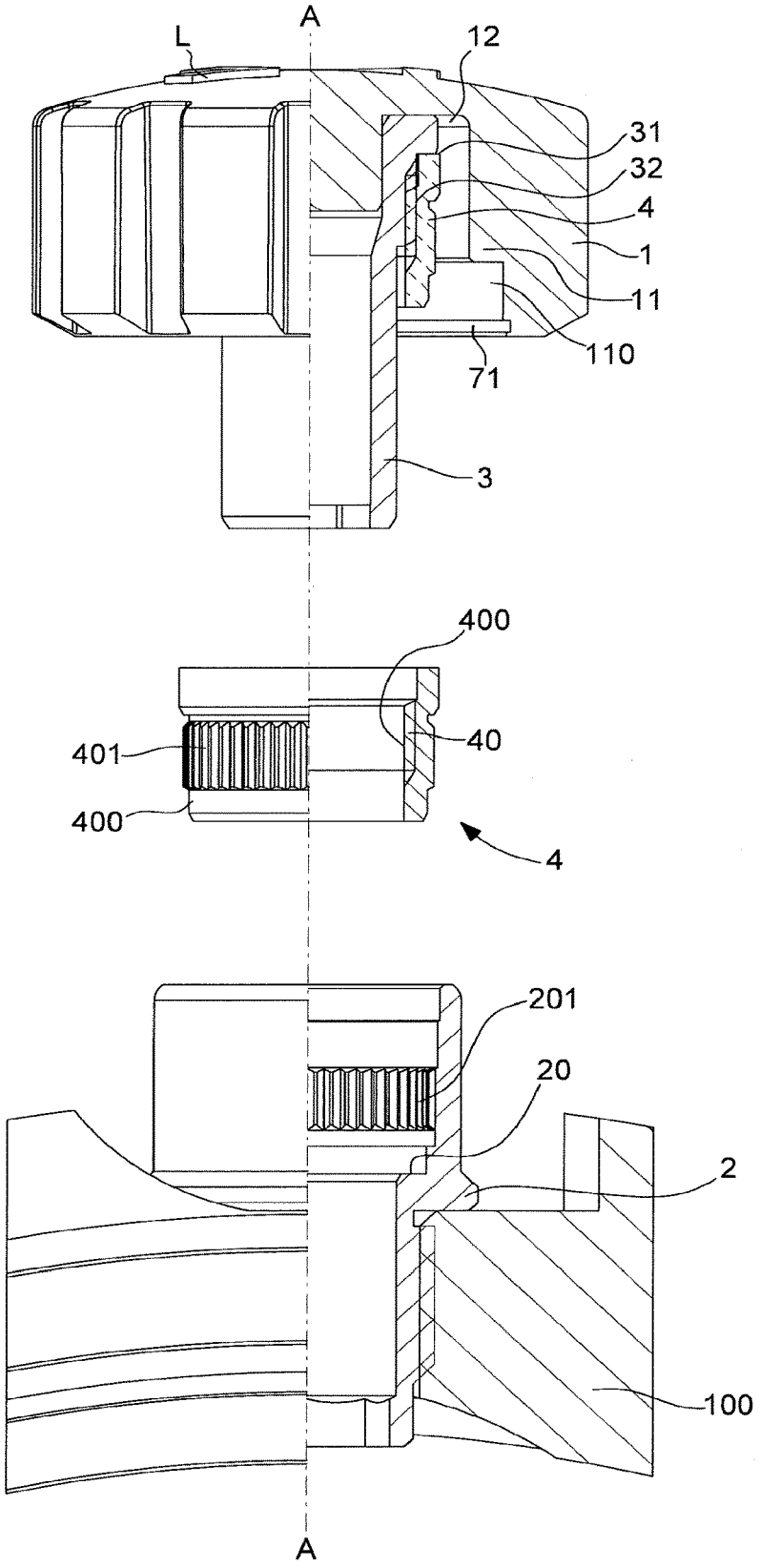
FIG. 3 is an exploded cross-sectional view of a screw-down orientable crown according to the invention.

FIGS. 2*a* and 2*b* illustrate a preferred embodiment of the indexing means according to the invention. According to the preferred embodiment described, the indexing means consist of the cooperation of flutes 201, 401 or toothings pressed against one another. Flutes 201 and 401 can also be observed in the exploded view of FIG. 3.

Such an arrangement has the advantage of reducing the number of parts employed for adjusting the angular orientation of the proposed crown 1.

As represented in FIGS. 2*a* and 2*b*, body 2 includes an inner shoulder 20, provided in the lower portion of body 2, forming a stop for ring 4 when it is pressed into body 2. Above and in immediate proximity to this inner shoulder 20, body 2 also includes flutes 201 extending over one portion of the top of body 2. Of course, flutes 201 could be replaced by toothings, grooves or any other shaped element capable of sliding in translation and locking the rotation of ring 4 on body 2.

Tube 3 includes a stop surface 31, formed in its upper portion, to abut against ring 4 when the crown is screwed down. Advantageously, stop surface 31 of tube 3 covers ring 4 and is flush with the upper portion of body 2, ring 4 then being housed between body 2 and tube 3. Such an arrangement of the crown makes it possible to limit its dimensions and the parts required for its construction.

According to another embodiment, not illustrated in the Figures, ring 4 is pressed onto the exterior of body 2 and the crown is then screwed onto ring 4 at skirt 11. In this embodiment, flutes 201 are on the inner surface of body 2 and flutes 401 are on the exterior of ring 4.

Control crown C according to the invention is assembled on the watch case middle in the following manner:

cover 1 is mounted on tube 3, for example, pressed or screwed thereon, body 2 is mounted inside case middle 100, by pressing or screwing and/or bonding, a gasket 7 may be placed inside cover 1, inside skirt 11, between body 2 and cover 1, ring 4 is screwed as far as possible onto tube 3 to form a single assembly, the orientation of the distinctive sign L is selected by means of flutes 201, 401, and the assembly obtained in the preceding step is pressed into body 2, by axially sliding flutes 401 of ring 4 between flutes 201 of body 2, until ring 4 abuts against inner shoulder 2 of body 2.

Thus, screw-down crown C will maintain its orientation, and every time that it is screwed down and/or unscrewed the distinctive sign will be correctly oriented.

The invention also concerns a watch case comprising a screw-down crown.

As a result of these different aspects of the invention, there is obtained a screw-down orientable crown of simple design allowing the angular position of the crown to be indexed while having a relatively small number of parts for its construction.

Of course, the present invention is not limited to the illustrated example and is capable of various variants and modifications which will appear to those skilled in the art. It will be understood that the invention is also applicable, for example, to a manual or automatic valve, and a push-piece, a corrector or an orientable case back.

NOMENCLATURE

1. Cover,
10. Inner surface of the cover,
11. Skirt,
12. Annular groove,
110. Annular housing,
2. Body,
20. Inner shoulder,
200. Outer surface,
201. Flutes,
3. Tube,
30. Axial cavity,
31. Stop surface,
32. External thread,
4. Ring,
40. Threaded section,
400. Inner surface,
401. Flutes,
5. Piston,
50. Blind hole,
51. Lower portion of the piston,
6. Spring,
7. Gasket
71. Retaining ring,
100. Case middle,
A. Axis of rotation of the crown,
C. Crown,
L. Distinctive sign.

What is claimed is:

1. A screw-down orientable crown comprising:
a cover integral with a tube and receiving a distinctive sign,
a fixed body mounted in a watch case middle and intended to receive said tube, and
means for adjusting the angular orientation of the cover with respect to said watch case middle,
wherein the means for adjusting the angular orientation of the cover comprise a ring arranged to be screwed onto the tube such that the tube extends below a bottommost surface of the ring to directly contact the fixed body, said ring comprising first indexing means arranged to cooperate with second indexing means formed in the body, said ring being pressed in and positioned on the body via the first and second indexing means.

2. The screw-down orientable crown according to claim 1, wherein the first and second indexing means comprise flutes configured to axially engage one inside the other.

3. The screw-down orientable crown according to claim 1, wherein the ring is pressed between the tube and the body, the tube, the ring and the body being housed inside an annular groove formed in the cover.

4. The screw-down orientable crown according to claim 1, wherein the body includes an inner shoulder forming a stop for the ring such that a bottommost surface of the ring directly abuts a topmost surface of the inner shoulder.

5. The screw-down orientable crown according to claim 1, wherein the tube includes a stop surface for the ring such that a bottommost surface of the stop surface of the tube abuts against a topmost surface of the ring.

6. The screw-down orientable crown according to claim 1, wherein sealing means are disposed between the cover and the body.

7. The screw-down orientable crown according to claim 6, wherein the sealing means comprise a gasket disposed between the cover and the body.

8. The screw-down orientable crown according to claim 1, wherein the tube includes an external thread arranged to cooperate with a threaded section of the ring to screw-down and/or unscrew the crown.

9. The screw-down orientable crown according to claim 1, wherein the ring is pressed between the body and the cover.

10. A timepiece comprising:
the screw-down orientable crown according to claim 1.

11. The screw-down orientable crown according to claim 1, wherein the body includes an inner shoulder forming a stop for the ring such that a bottommost surface of the ring directly abuts a topmost surface of the inner shoulder, and
wherein the tube includes a stop surface for the ring such that a bottommost surface of the stop surface of the tube abuts against a topmost surface of the ring.

12. A method for mounting the screw-down orientable crown according to claim 1, comprising:
mounting the cover on the tube,
mounting the body in the case middle,
screwing the ring as far as possible onto the tube to form a single assembly, and
selecting the orientation of the distinctive sign, and pressing the assembly obtained by the screwing into the body, by axially sliding flutes of the ring between flutes of the body, until the ring abuts against an inner shoulder of the body.

13. The mounting method according to claim 12, further comprising:
placing a gasket inside the cover between the body and the cover.

* * * * *